United States Patent [19]

Zohler et al.

[11] Patent Number: 5,018,573

[45] Date of Patent: May 28, 1991

[54] METHOD FOR MANUFACTURING A HIGH EFFICIENCY HEAT TRANSFER SURFACE AND THE SURFACE SO MANUFACTURED

[75] Inventors: Steven R. Zohler, Manlius, N.Y.; Richard C. Lewis, Merrimack, N.H.

[73] Assignee: Carrier Corporation, Syracuse, N.Y.

[21] Appl. No.: 451,683

[22] Filed: Dec. 18, 1989

[51] Int. Cl.[5] ..... F28F 13/18; B05D 3/02

[52] U.S. Cl. ..... 165/133; 427/373

[58] Field of Search ..... 165/133; 427/373

[56] References Cited

U.S. PATENT DOCUMENTS

| | | | |
|---|---|---|---|
| 3,384,154 | 5/1964 | Milton | 165/1 |
| 3,696,861 | 10/1972 | Webb | 165/133 |
| 3,768,290 | 10/1973 | Zatell | 72/68 |
| 3,990,862 | 11/1976 | Dahl et al. | 29/191.2 |
| 4,075,376 | 2/1978 | Jaeger | 165/133 |
| 4,129,181 | 12/1978 | Janowski et al. | 165/133 |
| 4,159,739 | 7/1979 | Brothers et al. | 165/133 |
| 4,354,550 | 10/1982 | Modahl et al. | 165/133 |
| 4,359,086 | 11/1982 | Sanborn et al. | 165/133 |
| 4,438,807 | 3/1984 | Mathur et al. | 165/133 |
| 4,663,243 | 5/1987 | Czikk et al. | 165/133 |
| 4,753,849 | 6/1988 | Zohler | 428/586 |
| 4,759,957 | 7/1988 | Eaton et al. | 427/373 |

*Primary Examiner*—Stephen M. Hepperle
*Assistant Examiner*—L. R. Leo
*Attorney, Agent, or Firm*—Charles E. Adams

[57] ABSTRACT

A method for manufacturing a heat transfer surface and the surface so manufactured. The porous surface is produced by flame spraying a metal substrate with a mixture of metallic and nonmetallic powder particles. The surface is then heated, causing the nonmetallic powder particles to oxidize into gases which diffuse from the surface, leaving voids where the nonmetallic powder particles were located. The voids provide nucleate boiling sites for a liquid being heated by the surface.

2 Claims, 1 Drawing Sheet

METHOD FOR MANUFACTURING A HIGH EFFICIENCY HEAT TRANSFER SURFACE AND THE SURFACE SO MANUFACTURED

BACKGROUND OF THE INVENTION

1. Field of the Invention

The present invention relates generally to heat transfer surfaces and the method by which such a surface may be manufactured. In particular, the invention relates to a porous surface for efficiently boiling a liquid such as a liquid refrigerant and to the method for flame spraying and processing a metal substrate to produce such a surface.

2. Description of the Prior Art

It is well known that one of the most effective mechanisms for transferring heat from a heated surface to a liquid in contact with the surface is nucleate boiling. In the nucleate boiling process, heat transferred from the heated surface vaporizes liquid in contact and bubbles are formed. Vapor trapped in a bubble is superheated by heat from the surface and the bubble grows in size. When the bubble size is sufficient, surface tension is overcome and the bubble breaks free of the surface. As the bubble leaves the surface, liquid enters the volume vacated by the bubble and vapor remaining in the volume has a source of additional liquid to vaporize to form another bubble. The continual forming of bubbles at the surface, the release of the bubbles from the surface and the rewetting of the surface together with the convective effect of the vapor bubbles rising through and mixing the liquid result in an improved heat transfer rate for the heat transfer surface.

It is also well known that the nucleate boiling process can be enhanced by configuring the heat transfer surface so that it has nucleation sites that provide locations for the entrapment of vapor and promote the formation of vapor bubbles. Simply roughening a heat transfer surface, for example, will provide nucleation sites that can improve the heat transfer characteristics of the surface over a similar smooth surface.

In boiling liquid refrigerants, for example in the evaporator of an air conditioning or refrigeration system, nucleation sites of the re-entrant type produce stable bubble columns and good surface heat transfer characteristics. A re-entrant type nucleation site is a surface cavity in which the opening of the cavity is smaller than the subsurface volume of the cavity. An excessive influx of the surrounding liquid can flood a re-entrant type nucleation site and deactivate it. By configuring the heat transfer surface so that it has relatively larger communicating subsurface channels with relatively smaller openings to the surface, flooding of the vapor entrapment or nucleation sites can be prevented and the heat transfer characteristics of the surface improved.

Over the years, in recognition of the above principles, many efforts have been made to produce heat transfer surfaces of improved efficiency having subsurface nucleation sites.

One method of manufacturing such a surface is by machining, rolling or milling. Several of such methods are disclosed in U.S. Pat. No. 3,696,861, U.S. Pat. No. 3,768,290, U.S. Pat. No. 4,159,739 and U.S. Pat. No. 4,438,807. These methods, however, do not lend themselves to the manufacture of a heat transfer surface on a substrate of a hard metal such as titanium.

Another method is disclosed in U.S. Pat. No. 4,129,181, in which a metal surface is prepared by first applying a reticulated organic foam layer then plating a thin metal coating on the foam substrate. The foam layer is then pyrolyzed at a temperature in the range of 575°–980° F. This heating can anneal the metal, resulting in degradation of its mechanical properties.

Flame spraying metallic particles on a metal substrate is another method of manufacture. Several variations of that technique have been developed and disclosed. In the method disclosed in U.S. Pat. No. 3,990,862, the oxidizer-fuel gas balance is of prime importance. In the method disclosed in U.S. Pat. No. 4,354,550, the surface must be preheated before being flame sprayed. In the method disclosed in U.S. Pat. No. 4,753,849, issued to the inventor of the present invention, two dissimilar metals are flame sprayed on to a metal substrate. One of the metals is then etched out by an acid bath to form subsurface cavities in the substrate surface.

The method disclosed in U.S. Pat. No. 4,359,086 combines machining and flame spraying techniques by first rolling and milling a surface then flame spraying the machined surfaces to form a porous coating over the machined channels on the surface.

There is, therefore, a need for a high efficiency heat transfer surface for boiling liquids that can be manufactured simply, economically and safely.

SUMMARY OF THE INVENTION

Accordingly, it is an object of the present invention to produce a heat transfer surface having superior heat transfer properties.

Another object of the invention is to afford a method of manufacturing such a high efficiency heat transfer surface that is economical, simple and safe in large-scale manufacturing operations.

Another object of the invention is to afford a method of manufacturing a high efficiency heat transfer surface that is adaptable to producing optimum heat transfer properties on surfaces of various metallic compositions used for boiling a variety of liquids.

These and other objects of the present invention are attained by a novel method of applying a porous coating on a metal substrate.

In the method of the invention, a metal substrate is flame sprayed with a mixture of a metallic powder and a powder of a nonmetallic material. The metallic powder particles fuse to the substrate and to each other, with the nonmetallic powder particles embedded within the flame sprayed coating. A second coating may be deposited on the first coating by a second flame spraying with a powder mixture containing a different proportion of metallic and nonmetallic powder particles and/or particles of different sizes. The resulting coating is then baked, by which step the nonmetallic particles evolve into a gaseous state and diffuse out of the coating, leaving voids or cavities in the coating where the nonmetallic particles were embedded.

The various features of novelty which characterize the invention are discussed with particularity in the claims which form a part of this specification. The accompanying drawings and descriptive matter, which illustrate and describe preferred embodiments of the invention, afford a better understanding of the invention, its advantages and the objects attained by its use.

BRIEF DESCRIPTION OF THE DRAWINGS

The accompanying drawings form a part of the specification. Throughout the various drawings, like reference numbers designate like or corresponding elements.

DESCRIPTION OF THE PREFERRED EMBODIMENT

The embodiment of the present invention described here is particularly suited to heat exchanger tubes used in evaporators of air conditioning or refrigeration systems. Such an evaporator is usually a tube type heat exchanger in which a plurality of tubes are contained within a single shell. The tubes are customarily arranged to provide a multiplicity of parallel flow paths through the heat exchanger for a fluid to be cooled. The tubes are immersed in a refrigerant which flows through the heat exchanger shell. The fluid is cooled by heat transfer through the walls of the tubes, which vaporizes the refrigerant in contact with the exterior surfaces of the tubes. The heat transfer capability of such an evaporator is largely determined by the heat transfer characteristics of the individual tubes.

Although the above embodiment of the invention is described here, the invention is equally suited to forming a high efficiency heat transfer surface for use in other applications.

Figure 1:
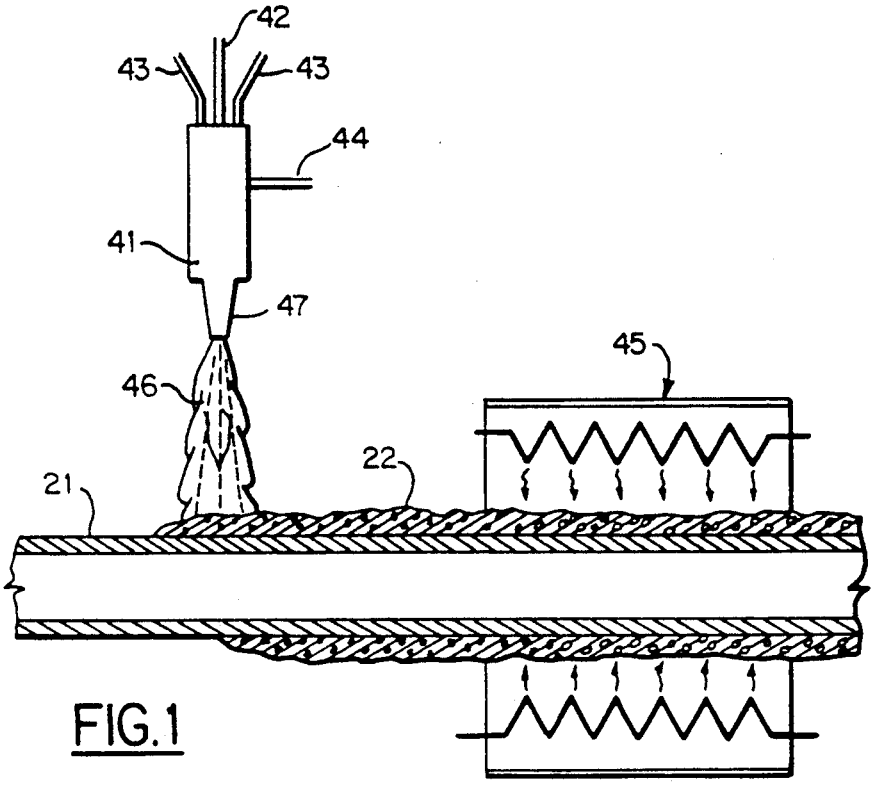
FIG. 1 is a schematic representation of the method of manufacturing a heat transfer surface according to one embodiment of the present invention, in which a single porous coating is applied to a copper heat exchanger tube.

The method for manufacturing a high efficiency heat transfer surface according to one embodiment of the invention is schematically represented in FIG. 1, in which copper tube 21 is moving from left to right and at the same time rotating about its longitudinal axis. In that embodiment, the exterior surface of the tube 21, having been first cleaned and prepared by grit blasting or a suitable alternate process (not shown), is flame sprayed, using the METCO ThermoSpray or an equivalent process, with a mixture of powdered copper particles and powder particles of a plastic material such as polymethyl methacrylate (e.o. Du Pont Lucite 4F), to form coating 22 on the exterior surface of the tube 21. In the flame spraying process, a mixture of the two powders 44 is fed into flame spraying gun 41, directed at the tube 21. Powder mixture 44 is propelled out of nozzle 47 of the gun by aspirating gas 42. There is also a supply of fuel gas 43 to the gun 41 which issues out of nozzle 47 and burns. Burning gases 46 fuse the copper, but not the plastic powder particles, as they are deposited on the outer surface of tube 21. Coating 22 thus formed on the outer surface of tube 21 is comprised of copper particles fused both to the tube and to each other and with particles of the plastic material embedded in the fused copper particles. The coated tube is then placed in an oven 45 where it is baked at a suitable temperature and for a suitable time to cause the plastic material to completely oxidize (into water vapor and carbon dioxide) and diffuse out of the coating. At the completion of the baking step, there remain voids in the coating where previously there were embedded plastic particles. Oven baking is described here, but any suitable means of heating the plastic powder particles to a temperature that will cause them to decompose and diffuse out of the coating may be employed.

Figure 2:
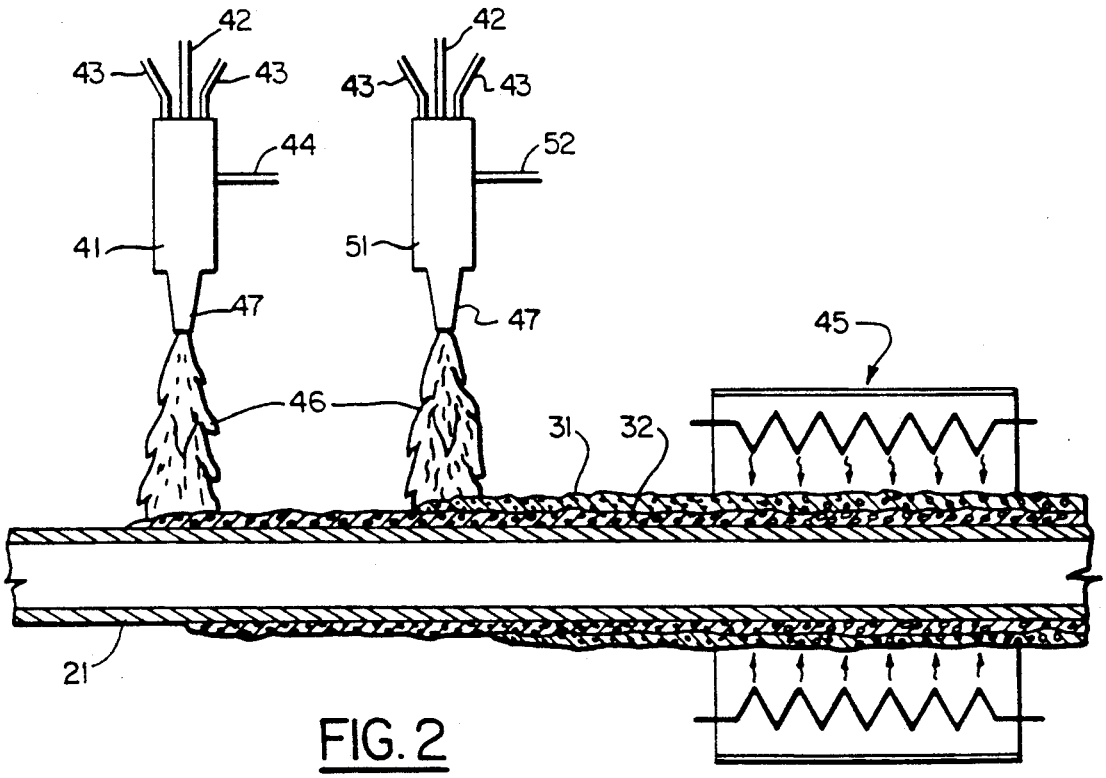
FIG. 2 is a schematic representation of the method of manufacturing a heat transfer surface according to another embodiment of the present invention, in which a first porous coating and then a second coating of a finer porosity are applied to a copper heat exchanger tube.

FIG. 2, in which a copper tube 21 is also moving from left to right and rotating about its longitudinal axis, schematically depicts the method for manufacturing a high efficiency heat transfer surface according to another embodiment of the invention. In this embodiment, coating 22 is applied to the exterior surface of tube 21 as described in the discussion of the embodiment represented by FIG. 1. Then, using a second flame spraying gun 51 and otherwise the same process and apparatus described previously, second mixture of powders 52 is applied to tube 21 by flame spraying to form second coating 31 over first coating 32. The same flame spraying gun can, of course, be used to apply both coatings. The coated tube is then heated as previously described in connection with the process represented by FIG. 1. Second powder mixture 52 is also composed of powdered copper particles and powdered particles of a plastic material such a polymethyl methacrylate, but differs from the powder mix used to form the first coating in that the proportions of copper and plastic powders in the mix and the size of the powder particles are such as to produce, when the plastic is baked out of the coating, a finer or smaller pore or cavity structure in the second coating as opposed to the structure in the first coating. The result is a heat transfer surface having relatively larger interconnecting subsurface channels with relatively smaller pores or cavities at the surface.

The method for manufacturing embodied in the present invention is adaptable to producing a high efficiency porous heat transfer surface on other types of heat transfer surfaces, such as plates, and using other metals, such as aluminum, as the substrate. The metallic powder used in the spray powder mixture or mixtures can be the same metallic composition as the substrate but may be of a different metal, e.g. aluminum on copper.

The size of both the metallic and nonmetallic powder particles, the proportions of the two powders in the spray powder mixture and whether the single coating or double coating method is used are variables which can be altered to produce a particular configuration of the heat transfer surface which is optimum for the particular liquid to be boiled, based on that liquid's boiling and flow properties.

The method of manufacture embodied in this invention affords a simple and cost effective means to produce a high efficiency heat transfer surface and avoids the complicated mechanical processes and use of hazardous and corrosive chemicals employed in prior art methods. The method is adaptable, when used to produce heat exchanger tubes, to the rapid production of large quantities of high efficiency tubes.

Polymethyl methacrylate powder is particularly suited for use as the nonmetallic component of the powder spray mixture, for the gases produced when the powder particles decompose in the baking process and diffuse out of the coating are nontoxic and harmless to the environment.

While the invention has been described with respect to the particular embodiments disclosed, it is not confined to the details of those embodiments set forth. The scope of the invention is therefore intended to cover all embodiments and be limited only by the scope of the claims.

What is claimed is:

1. A heat transfer surface comprising:

a metallic substrate;

a first coating of metallic powder particles deposited on said metallic substrate so that parts of said metallic powder particles are fused to said metallic substrate and to each other with interstitial voids among said metallic powder particles; and a second coating of metallic powder particles deposited on said first coating of metallic powder particles so that parts of said metallic powder particles of said second coating are fused to said metallic powder particles of said first coating and to each other with interstitial voids among said metallic powder particles of said second coating, said interstitial voids of said second coating having a finer or smaller pore or cavity structure relative to said interstitial voids of said first coating.

2. The heat transfer surface of claim 1 in which said metallic substrate comprises a copper tube, and said metallic powder particles of said first coating and said metallic powder particles of said second coating are comprised of copper.

* * * * *